US009347269B2

(12) United States Patent
Marchand et al.

(10) Patent No.: US 9,347,269 B2
(45) Date of Patent: May 24, 2016

(54) ADJUSTABLE BEND ASSEMBLY FOR A DOWNHOLE MOTOR

(71) Applicant: National Oilwell Varco, L.P., Houston, TX (US)

(72) Inventors: Nicholas Ryan Marchand, Edmonton (CA); Jonathan Ryan Prill, Edmonton (CA)

(73) Assignee: National Oilwell Varco, L.P., Houston, TX (US)

( * ) Notice: Subject to any disclaimer, the term of this patent is extended or adjusted under 35 U.S.C. 154(b) by 522 days.

(21) Appl. No.: 13/786,076

(22) Filed: Mar. 5, 2013

(65) Prior Publication Data

US 2014/0251695 A1 Sep. 11, 2014

(51) Int. Cl.
*E21B 7/06* (2006.01)
*E21B 4/02* (2006.01)

(52) U.S. Cl.
CPC .. *E21B 7/067* (2013.01); *E21B 4/02* (2013.01)

(58) Field of Classification Search
CPC ..... E21B 4/02; E21B 7/068
See application file for complete search history.

(56) References Cited

U.S. PATENT DOCUMENTS

| | | | | |
|---|---|---|---|---|
| 4,492,276 | A | 1/1985 | Kamp | |
| 4,522,272 | A | 6/1985 | Beimgraben | |
| 4,904,228 | A | 2/1990 | Frear et al. | |
| 5,048,621 | A | 9/1991 | Bailey | |
| 5,050,692 | A | 9/1991 | Beimgraben | |
| 5,052,501 | A | 10/1991 | Wenzel | |
| 5,343,966 | A | 9/1994 | Wenzel et al. | |
| 6,213,226 | B1 * | 4/2001 | Eppink et al. | 175/61 |
| 6,328,119 | B1 * | 12/2001 | Gillis et al. | 175/325.1 |
| 6,516,901 | B1 * | 2/2003 | Falgout, Sr. | 175/74 |
| 6,554,083 | B1 | 4/2003 | Kerstetter | |
| 8,157,025 | B2 | 4/2012 | Johnson | |
| 2005/0236189 | A1 | 10/2005 | Rankin | |
| 2009/0275415 | A1 | 11/2009 | Prill | |
| 2011/0005839 | A1 | 1/2011 | Marchand | |
| 2013/0051716 | A1 | 2/2013 | Cioceanu | |
| 2014/0224545 | A1 * | 8/2014 | Nicol-Seto | E21B 17/03 175/107 |

FOREIGN PATENT DOCUMENTS

CA 2578879 A1 8/2008

OTHER PUBLICATIONS

International Search Report and Written Opinion dated Nov. 27, 2014, for International Application No. PCT/US2014/015499, international filing date Feb. 10, 2014.

* cited by examiner

*Primary Examiner* — William P Neuder
(74) *Attorney, Agent, or Firm* — Conley Rose, P.C.

(57) ABSTRACT

A downhole motor for directional drilling includes a driveshaft assembly including a driveshaft housing and a driveshaft rotatably disposed within the driveshaft housing. In addition, the downhole motor includes a bearing assembly including a bearing housing and a bearing mandrel rotatably disposed within the bearing housing. The bearing mandrel has a first end directly connected to the driveshaft with a universal joint and a second end coupled to a drill bit. Further, the downhole motor includes an adjustment mandrel configured to adjust an acute deflection angle θ between the central axis of the bearing housing and the central axis of the driveshaft housing. The adjustment mandrel has a central axis coaxially aligned with the bearing housing, a first end coupled to the driveshaft housing, and a second end coupled to the bearing housing.

48 Claims, 10 Drawing Sheets

ADJUSTABLE BEND ASSEMBLY FOR A DOWNHOLE MOTOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of the Disclosure

The disclosure relates generally to downhole motors used to drill boreholes in earthen formations for the ultimate recovery of oil, gas, or minerals. More particularly, the disclosure relates to downhole motors including adjustable bend assemblies for directional drilling.

2. Background of the Technology

In drilling a borehole into an earthen formation, such as for the recovery of hydrocarbons or minerals from a subsurface formation, it is conventional practice to connect a drill bit onto the lower end of a drillstring formed from a plurality of pipe joints connected together end-to-end, and then rotate the drill string so that the drill bit progresses downward into the earth to create a borehole along a predetermined trajectory. In addition to pipe joints, the drillstring typically includes heavier tubular members known as drill collars positioned between the pipe joints and the drill bit. The drill collars increase the vertical load applied to the drill bit to enhance its operational effectiveness. Other accessories commonly incorporated into drill strings include stabilizers to assist in maintaining the desired direction of the drilled borehole, and reamers to ensure that the drilled borehole is maintained at a desired gauge (i.e., diameter). In vertical drilling operations, the drillstring and drill bit are typically rotated from the surface with a top dive or rotary table.

During the drilling operations, drilling fluid or mud is pumped under pressure down the drill string, out the face of the drill bit into the borehole, and then up the annulus between the drill string and the borehole sidewall to the surface. The drilling fluid, which may be water-based or oil-based, is typically viscous to enhance its ability to carry borehole cuttings to the surface. The drilling fluid can perform various other valuable functions, including enhancement of drill bit performance (e.g., by ejection of fluid under pressure through ports in the drill bit, creating mud jets that blast into and weaken the underlying formation in advance of the drill bit), drill bit cooling, and formation of a protective cake on the borehole wall (to stabilize and seal the borehole wall).

Recently, it has become increasingly common and desirable in the oil and gas industry to drill horizontal and other non-vertical or deviated boreholes (i.e., "directional drilling"), to facilitate greater exposure to and production from larger regions of subsurface hydrocarbon-bearing formations than would be possible using only vertical boreholes. In directional drilling, specialized drill string components and "bottomhole assemblies" (BHAs) are often used to induce, monitor, and control deviations in the path of the drill bit, so as to produce a borehole of the desired deviated configuration.

Directional drilling is typically carried out using a downhole or mud motor provided in the bottomhole assembly (BHA) at the lower end of the drillstring immediately above the drill bit. Downhole motors typically include several components, such as, for example (in order, starting from the top of the motor): (1) a power section including a stator and a rotor rotatably disposed in the stator; (2) a drive shaft assembly including a drive shaft disposed within a housing, with the upper end of the drive shaft being coupled to the lower end of the rotor; and (3) a bearing assembly positioned between the driveshaft assembly and the drill bit for supporting radial and thrust loads. For directional drilling, the motor often includes a bent housing to provide an angle of deflection between the drill bit and the BHA. The deflection angle is usually between 0° and 5°. The axial distance between the lower end of the drill bit and bend in the motor is commonly referred to as the "bit-to-bend" distance.

To drill straight sections of borehole with a bent motor, the entire drillstring and BHA are rotated from the surface with the drillstring, thereby rotating the drill bit about the longitudinal axis of the drillstring; and to change the trajectory of the borehole, the drill bit is rotated exclusively with the downhole motor, thereby enabling the drill bit to rotate about its own central axis, which is oriented at the deflection angle relative to the drillstring due to the bent housing. Since the drill bit is skewed (i.e., oriented at the deflection angle) when the entire drillstring is rotated while drilling straight sections, the downhole motor is subjected to bending moments which may result in potentially damaging stresses at critical locations within the motor.

BRIEF SUMMARY OF THE DISCLOSURE

These and other needs in the art are addressed in one embodiment by a downhole motor for directional drilling. In an embodiment, the downhole motor comprises a driveshaft assembly including a driveshaft housing and a driveshaft rotatably disposed within the driveshaft housing. The driveshaft housing has a central axis, a first end, and a second end opposite the first end. The driveshaft has a central axis, a first end, and a second end opposite the first end. In addition, the downhole motor comprises a bearing assembly including a bearing housing and a bearing mandrel rotatably disposed within the bearing housing. The bearing housing has a central axis, a first end comprising a connector, and a second end opposite the first end. The bearing mandrel has a central axis coaxially aligned with the central axis of the bearing housing, a first end directly connected to the second end of the driveshaft with a universal joint, and a second end coupled to a drill bit. Further, the downhole motor comprises an adjustment mandrel configured to adjust an acute deflection angle $\theta$ between the central axis of the bearing housing and the central axis of the driveshaft housing. The adjustment mandrel has a central axis coaxially aligned with the central axis of the bearing housing, a first end, and a second end opposite the first end. The first end of the adjustment mandrel is coupled to the second end of the driveshaft housing and the second end of the adjustment mandrel is coupled to the first end of the bearing housing.

These and other needs in the art are addressed in another embodiment by a downhole motor for directional drilling. In an embodiment, the downhole motor comprises a driveshaft assembly including a driveshaft housing and a driveshaft rotatably disposed within the driveshaft housing. The driveshaft housing has a central axis, a first end, and a second end opposite the first end. The driveshaft has a central axis, a first end, and a second end opposite the first end. In addition, the downhole motor comprises a bearing assembly including a bearing housing and a bearing mandrel coaxially disposed within the bearing housing. The bearing housing has a central axis, a first end, and a second end opposite the first end. The bearing mandrel has a first end pivotally coupled to the second end of the driveshaft and a second end coupled to a drill bit. The first end of the bearing mandrel extends from the bearing housing into the driveshaft housing. Further, the downhole motor comprises an adjustment mandrel having a first end coupled to the second end of the driveshaft housing and a second end coupled to first end of the bearing housing. Rotation of the adjustment mandrel relative to the driveshaft housing is configured to adjust an acute deflection angle θ between the central axis of the driveshaft housing and the central axis of the bearing housing.

These and other needs in the art are addressed in another embodiment by a downhole motor for directional drilling. In an embodiment, the downhole motor comprises a driveshaft assembly including a driveshaft housing and a driveshaft rotatably disposed within the driveshaft housing. The driveshaft housing has a central axis, a first end, and a second end opposite the first end. The driveshaft has a central axis, a first end, a second end opposite the first end, and a receptacle extending axially from the second end of the driveshaft. In addition, the downhole motor comprises a bearing assembly including a bearing housing and a bearing mandrel rotatably disposed within the bearing housing. The bearing housing has a central axis, a first end, and a second end opposite the first end. The bearing mandrel has a first end pivotally coupled to the driveshaft and a second end coupled to a drill bit. The first end of the bearing mandrel is disposed within the receptacle of the driveshaft. The central axis of the driveshaft housing is oriented at an acute deflection angle θ relative to the central axis of the bearing housing.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the disclosure, reference will now be made to the accompanying drawings in which.

DETAILED DESCRIPTION OF THE PREFERRED EMBODIMENTS

Figure 1:
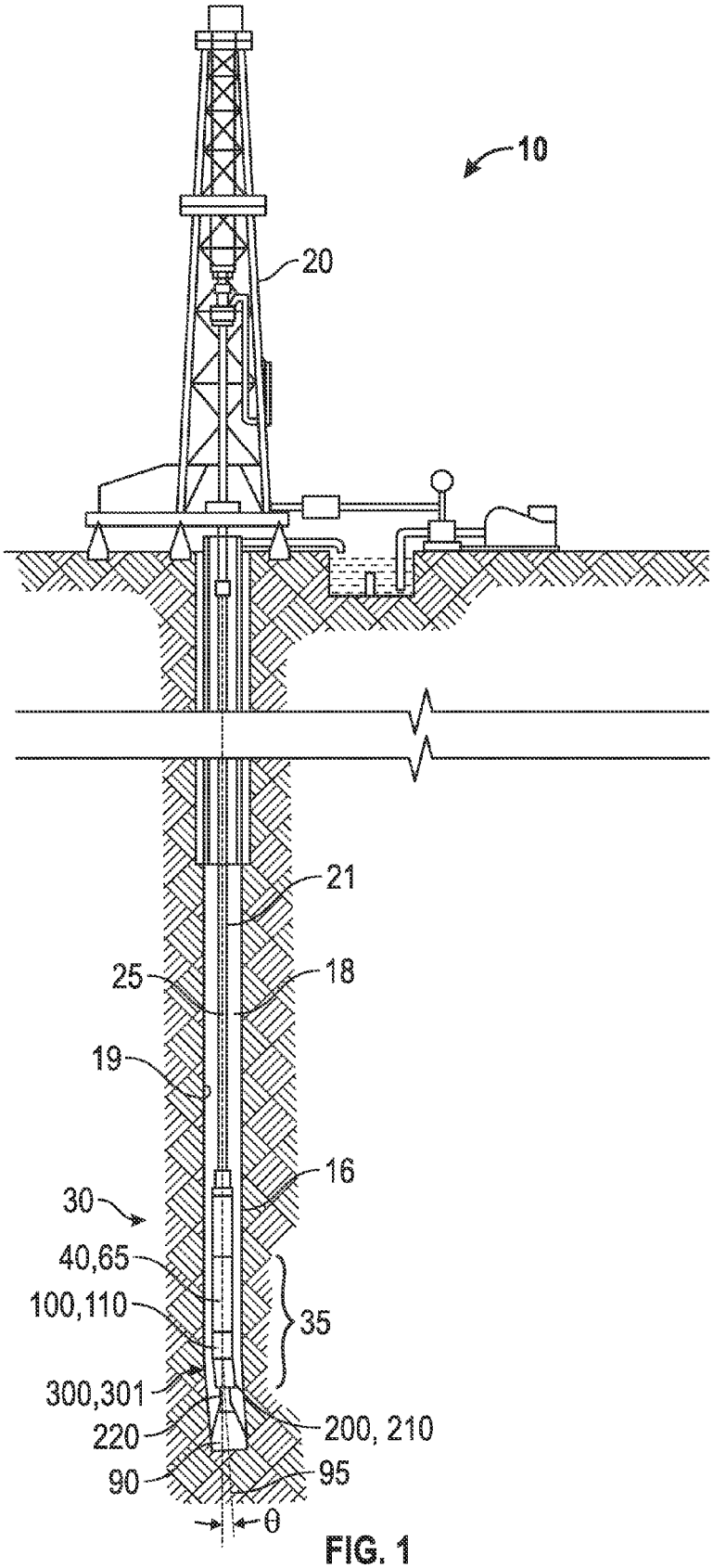
FIG. 1 is a schematic partial cross-sectional view of a drilling system including an embodiment of a downhole mud motor in accordance with the principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

Referring now to FIG. 1, a system 10 for drilling for drilling a borehole 16 in an earthen formation is shown. In this embodiment, system 10 includes a drilling rig 20 disposed at the surface, a drill string 21 extending downhole from rig 20, a bottomhole assembly (BHA) 30 coupled to the lower end of drillstring 21, and a drill bit 90 attached to the lower end of BHA 30. A downhole mud motor 35 is provided in BHA 30 for facilitating the drilling of deviated portions of borehole 16. Moving downward along BHA 30, motor 35 includes a hydraulic drive or power section 40, a driveshaft assembly 100, and a bearing assembly 200. The portion of BHA 30 disposed between drillstring 21 and motor 35 can include other components, such as drill collars, measurement-while-drilling (MWD) tools, reamers, stabilizers and the like.

Power section 40 converts the fluid pressure of the drilling fluid pumped downward through drillstring 21 into rotational torque for driving the rotation of drill bit 90. Drive shaft assembly 100 and bearing assembly 200 transfer the torque generated in power section 40 to bit 90. With force or weight applied to the drill bit 90, also referred to as weight-on-bit ("WOB"), the rotating drill bit 90 engages the earthen formation and proceeds to form borehole 16 along a predetermined path toward a target zone. The drilling fluid or mud pumped down the drill string 21 and through motor 30 passes out of the face of drill bit 90 and back up the annulus 18 formed between drill string 21 and the wall 19 of borehole 16. The drilling fluid cools the bit 90, and flushes the cuttings away from the face of bit 90 and carries the cuttings to the surface.

Figure 2:
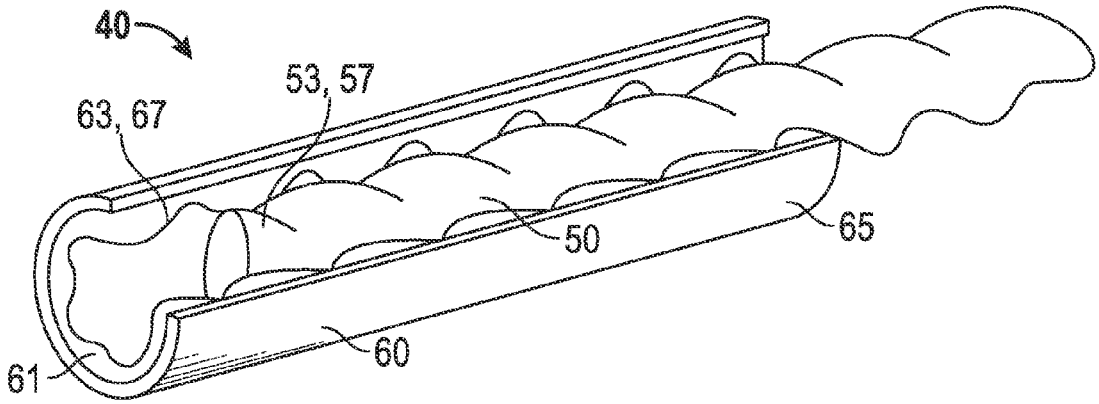
FIG. 2 is a perspective, partial cut-away view of the power section of FIG. 1.
Figure 3:
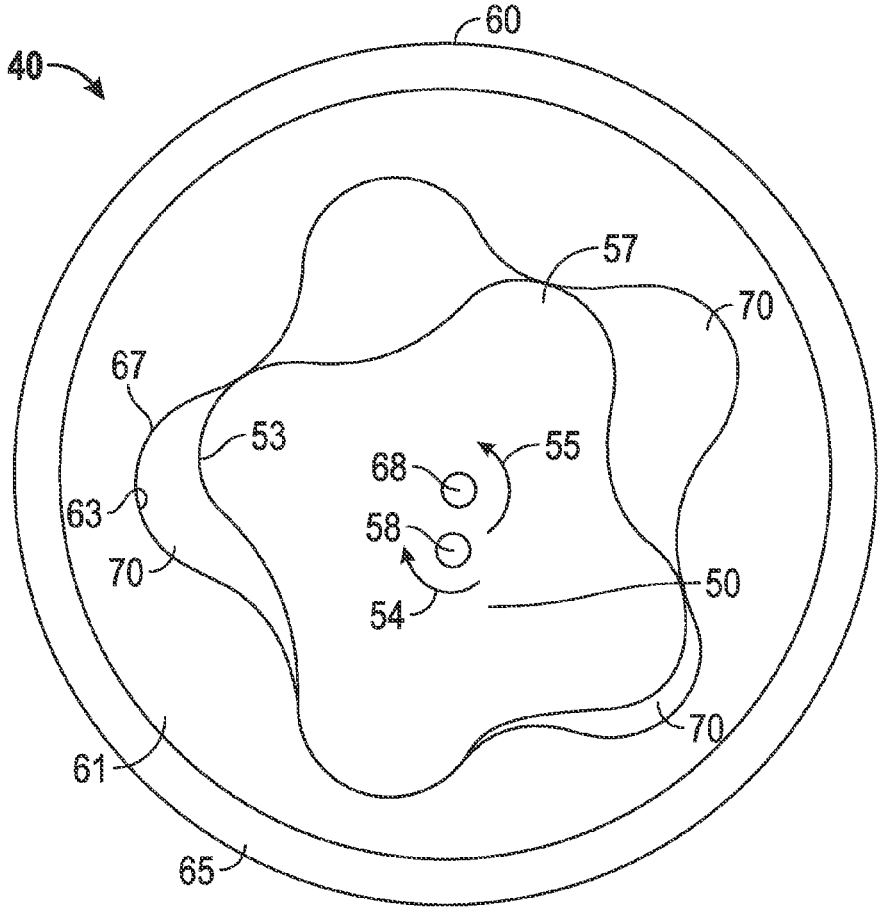
FIG. 3 is a cross-sectional end view of the power section of FIG. 1.

Referring now to FIGS. 2 and 3, hydraulic drive section 40 comprises a helical-shaped rotor 50, preferably made of steel that may be chrome-plated or coated for wear and corrosion resistance, disposed within a stator 60 comprising a cylindrical stator housing 65 lined with a helical-shaped elastomeric insert 61. Helical-shaped rotor 50 defines a set of rotor lobes 57 that intermesh with a set of stator lobes 67 defined by the helical-shaped insert 61. As best shown in FIG. 3, the rotor 50 has one fewer lobe 57 than the stator 60. When the rotor 50 and the stator 60 are assembled, a series of cavities 70 are formed between the outer surface 53 of the rotor 50 and the inner surface 63 of the stator 60. Each cavity 70 is sealed from adjacent cavities 70 by seals formed along the contact lines between the rotor 50 and the stator 60. The central axis 58 of the rotor 50 is radially offset from the central axis 68 of the stator 60 by a fixed value known as the "eccentricity" of the rotor-stator assembly. Consequently, rotor 50 may be described as rotating eccentrically within stator 60.

During operation of the hydraulic drive section 40, fluid is pumped under pressure into one end of the hydraulic drive section 40 where it fills a first set of open cavities 70. A pressure differential across the adjacent cavities 70 forces the rotor 50 to rotate relative to the stator 60. As the rotor 50 rotates inside the stator 60, adjacent cavities 70 are opened and filled with fluid. As this rotation and filling process repeats in a continuous manner, the fluid flows progressively down the length of hydraulic drive section 40 and continues to drive the rotation of the rotor 50. Driveshaft assembly 100 shown in FIG. 1 includes a driveshaft discussed in more detail below that has an upper end coupled to the lower end of rotor 50. The rotational motion and torque of rotor 50 is transferred to drill bit 90 via driveshaft assembly 100 and bearing assembly 200.

In this embodiment, driveshaft assembly 100 is coupled to an outer housing 210 of bearing assembly 200 with a bend adjustment assembly 300 that provides an adjustable bend 301 along motor 35. Due to bend 301, a deflection angle θ is formed between the central axis 95 of drill bit 90 and the longitudinal axis 25 of drill string 21. To drill a straight section of borehole 16, drillstring 21 is rotated from rig 20 with a rotary table or top drive to rotate BHA 30 and drill bit 90 coupled thereto. Drillstring 21 and BHA 30 rotate about the longitudinal axis of drillstring 21, and thus, drill bit 90 is also forced to rotate about the longitudinal axis of drillstring 21.

Referring again to FIG. 1, with bit 90 disposed at deflection angle θ, the lower end of drill bit 90 distal BHA 30 seeks to move in an arc about longitudinal axis 25 of drillstring 21 as it rotates, but is restricted by the sidewall 19 of borehole 16, thereby imposing bending moments and associated stress on BHA 30 and mud motor 35. In general, the magnitudes of such bending moments and associated stresses are directly related to the bit-to-bend distance D—the greater the bit-to-bend distance D, the greater the bending moments and stresses experienced by BHA 30 and mud motor 35.

In general, driveshaft assembly 100 functions to transfer torque from the eccentrically-rotating rotor 50 of power section 40 to a concentrically-rotating bearing mandrel 220 of bearing assembly 200 and drill bit 90. As best shown in FIG. 3, rotor 50 rotates about rotor axis 58 in the direction of arrow 54, and rotor axis 58 rotates about stator axis 68 in the direction of arrow 55. However, drill bit 90 and bearing mandrel 220 are coaxially aligned and rotate about a common axis that is offset and/or oriented at an acute angle relative to rotor axis 58. Thus, driveshaft assembly 100 converts the eccentric rotation of rotor 50 to the concentric rotation of bearing mandrel 220 and drill bit 90, which are radially offset and/or angularly skewed relative to rotor axis 58.

Figure 4:
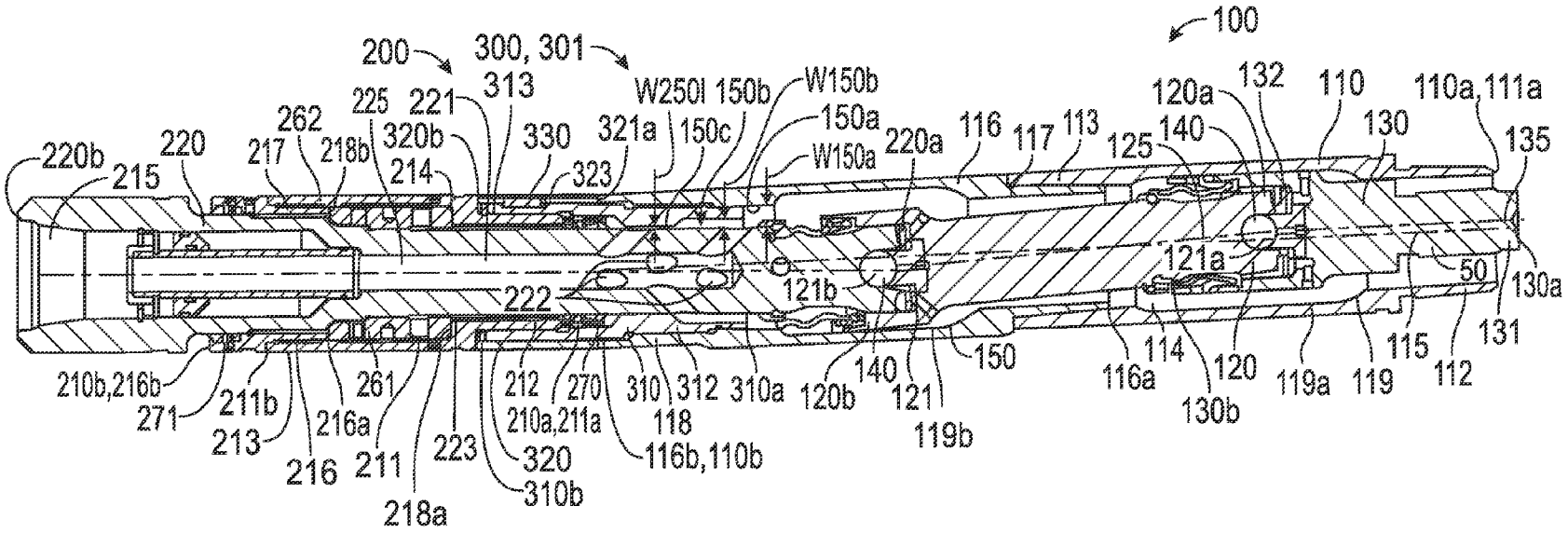
FIG. 4 is an enlarged cross-sectional view of the mud motor of FIG. 1 illustrating the driveshaft assembly, the bearing assembly, and the bend adjustment assembly.

Referring now to FIG. 4, driveshaft assembly 100 includes an outer housing 110 and a one-piece (i.e., unitary) driveshaft 120 rotatably disposed within housing 110. Housing 110 has a linear central or longitudinal axis 115, an upper end **110*a* coupled end-to-end with the lower end of stator housing 65, and a lower end 110*b* coupled to housing 210 of bearing assembly 200 via bend adjustment assembly 300. As best shown in FIG. 1, in this embodiment, driveshaft housing 110 is coaxially aligned with stator housing 65, however, due to bend 301 between driveshaft assembly 100 and bearing assembly 200, driveshaft housing 100 is oriented at deflection angle θ relative to bearing assembly 200 and drill bit 90**.

In this embodiment, driveshaft housing 110 is formed from a pair of coaxially aligned, generally tubular housings connected together end-to-end. Namely, driveshaft housing 110 includes a first or upper housing section 111 extending axially from upper end **110*a* and a second or lower housing section 116 extending axially from lower end 110*b* to upper housing section 111. Upper housing section 111 has a first or upper end 111*a* coincident with end 110*a* and a second or lower end 111*b* coupled to lower housing section 116. Upper end 110*a*, 111*a* comprises a threaded connector 112 and lower end 111*b* comprises a threaded connector 113. Threaded connectors 112, 113 are coaxially aligned, each being concentrically disposed about axis 115. In this embodiment, connector 112 is an externally threaded connector or pin end, and connector 113** is an internally threaded connector or box end.

Figure 5:
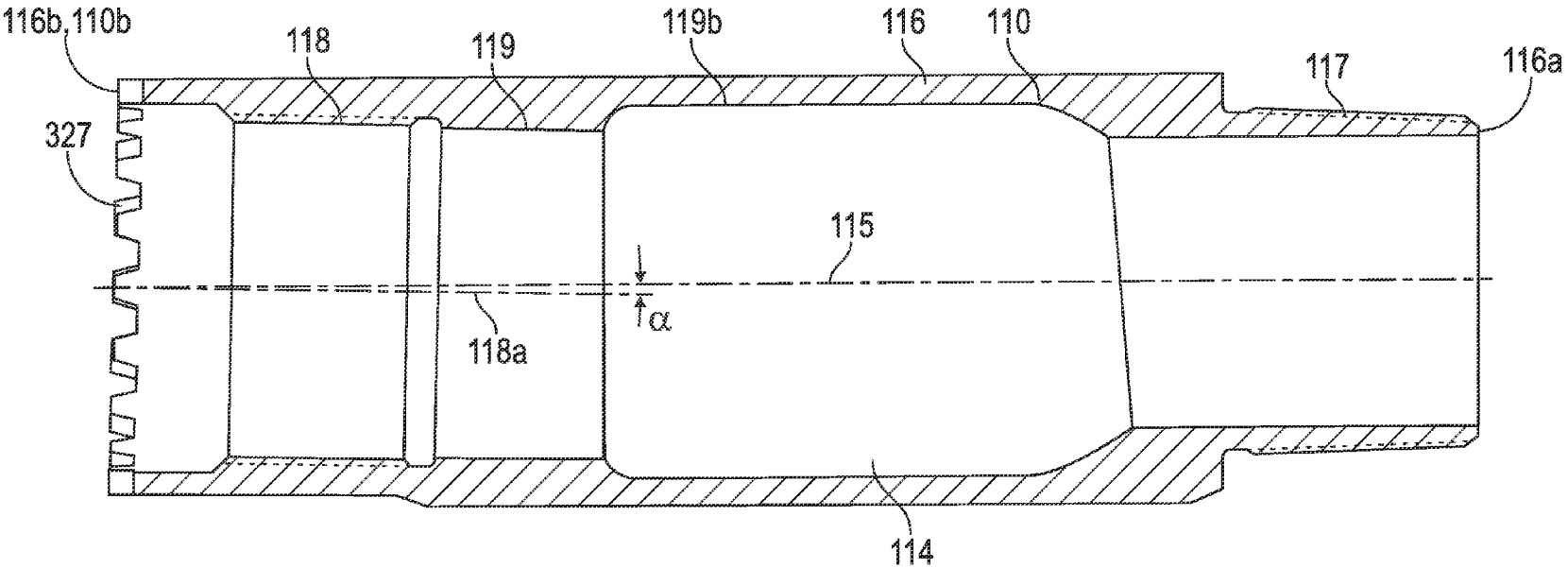
FIG. 5 is an enlarged cross-sectional view of the lower housing section of the driveshaft housing of FIG. 4.

Referring now to FIGS. 4 and 5, lower housing section 116 has a first or upper end **116*a* coupled to upper housing section 111 and a second or lower end 116*b* coincident with end 110*b*. Upper end 116*a* comprises a threaded connector 117 and lower end 110*b*, 116*b* comprises a threaded connector 118. Threaded connector 117 is coaxially aligned with connectors 112, 113 and concentrically disposed about axis 115, however, threaded connector 118 is concentrically disposed about an axis 118*a* oriented at a non-zero acute angle α relative to axis 115. In this embodiment, connector 117 is an externally threaded connector or pin end, and connector 118 is an internally threaded connector or box end. Thus, axis 118*a* is the central axis of the threaded inner cylindrical surface of lower housing section 116 at end 116*b*. Accordingly, connector 118** may be described as being "offset." Angle α is preferably greater than 0° and less than or equal to 2°.

Externally threaded connector 112 of upper housing section 111 threadably engages a mating internally threaded connector or box end disposed at the lower end of stator housing 65, and internally threaded connector 113 of upper housing section 111 threadably engages mating externally threaded connector 117 of lower housing section 116. As will be described in more detail below, lower end 110*b*, 116*b* of lower housing section 116, and in particular internally threaded offset connector 118, threadably engages a mating externally threaded component of bend adjustment assembly 300.

Driveshaft housing 110 has a central through bore or passage 114 extending axially between ends 110*a*, 110*b*. Bore 114 defines a radially inner surface 119 within housing 110 that includes a first or upper annular recess 119*a* and a second or lower annular recess 119*b* axially spaced below recess 119*a*. In this embodiment, upper recess 119*a* is disposed along upper housing section 111 and lower recess 119*b* is disposed along lower housing section 116. Recesses 119*a*, 119*b* are disposed at a radius that is greater than the remainder of inner surface 119 and provide sufficient clearance for the movement (rotation and pivoting) of driveshaft 120.

Referring again to FIG. 4, driveshaft 120 has a linear central or longitudinal axis 125, a first or upper end 120*a*, and a second or lower end 120*b* opposite end 120*a*. Upper end 120*a* is pivotally coupled to the lower end of rotor 50 with a driveshaft adapter 130 and universal joint 140, and lower end 120*b* is pivotally coupled to an upper end 220*a* of bearing mandrel 220 with a universal joint 140. In this embodiment, upper end 120*a* and one universal joint 140 are disposed within driveshaft adapter 130, whereas lower end 120*b* comprises an axially extending counterbore or receptacle 121 that receives upper end 220*a* of bearing mandrel 220 and one universal joint 140. Thus, upper end 120*a* may also be referred to as male end 120*a*, and lower end 120*b* may also be referred to as female end 120*b*.

Driveshaft adapter 130 extends along a central or longitudinal axis 135 between a first or upper end 130*a* coupled to rotor 50, and a second or lower end 130*b* coupled to upper end 120*a* of driveshaft 120. Upper end 130*a* comprises an externally threaded male pin or pin end 131 that threadably engages a mating female box or box end at the lower end of rotor 50. A receptacle or counterbore 132 extends axially (relative to axis 135) from end 130*b*. Upper male end 120*a* of driveshaft 120 is disposed within counterbore 132 and pivotally coupled to adapter 130 with one universal joint 140 disposed within counterbore 132.

Universal joints 140 allow ends 120*a*, 120*b* to pivot relative to adapter 130 and bearing mandrel 220, respectively, while transmitting rotational torque between rotor 50 and bearing mandrel 220. Specifically, upper universal joint 140 allows upper end 120*a* to pivot relative to upper adapter 130 about an upper pivot point 121*a*, and lower universal joint 140 allows lower end 120*b* to pivot relative to bearing mandrel 220 about a lower pivot point 121*b*. Upper adapter 130 is coaxially aligned with rotor 50 (i.e., axis 135 of upper adapter and rotor axis 58 are coaxially aligned). Since rotor axis 58 is radially offset and/or oriented at an acute angle relative to the central axis of bearing mandrel 220, axis 125 of driveshaft 120 is skewed or oriented at an acute angle relative to axis 115 of housing 110, axis 58 of rotor 50, and the central axis 225 of bearing mandrel 220. However, universal joints 140 accommodate for the angularly skewed driveshaft 120, while simultaneously permitting rotation of the driveshaft 120 within housing 110. Ends 120*a*, 120*b* and corresponding universal joints 140 are axially positioned within recesses 119*a*, 119*b*, respectively, of housing 110, which provide clearance for end 120*b*, 130*b* as driveshaft 120 simultaneously rotates and pivots within housing 110.

In general, each universal joint (e.g., each universal joint 140) may comprise any joint or coupling that allows two parts that are coupled together and not coaxially aligned with each other (e.g., driveshaft 120 and adapter 130 oriented at an acute angle relative to each other) limited freedom of movement in any direction while transmitting rotary motion and torque including, without limitation, universal joints (Cardan joints, Hardy-Spicer joints, Hooke joints, etc.), constant velocity joints, or any other custom designed joint.

As previously described, adapter 130 couples driveshaft 120 to the lower end of rotor 50. During drilling operations, high pressure drilling fluid or mud is pumped under pressure down drillstring 21 and through cavities 70 between rotor 50 and stator 60, causing rotor 50 to rotate relative to stator 60. Rotation of rotor 50 drives the rotation of adapter 130, driveshaft 120, the bearing assembly mandrel, and drill bit 90. The drilling fluid flowing down drillstring 21 through power section 40 also flows through driveshaft assembly 100 and bearing assembly 200 to drill bit 90, where the drilling fluid flows through nozzles in the face of bit 90 into annulus 18. Within driveshaft assembly 100 and the upper portion of bearing assembly 200, the drilling fluid flows through an annulus 150 formed between driveshaft housing 110 and driveshaft 120, and between driveshaft housing 110 and bearing mandrel 220 of bearing assembly 200.

Figure 6:
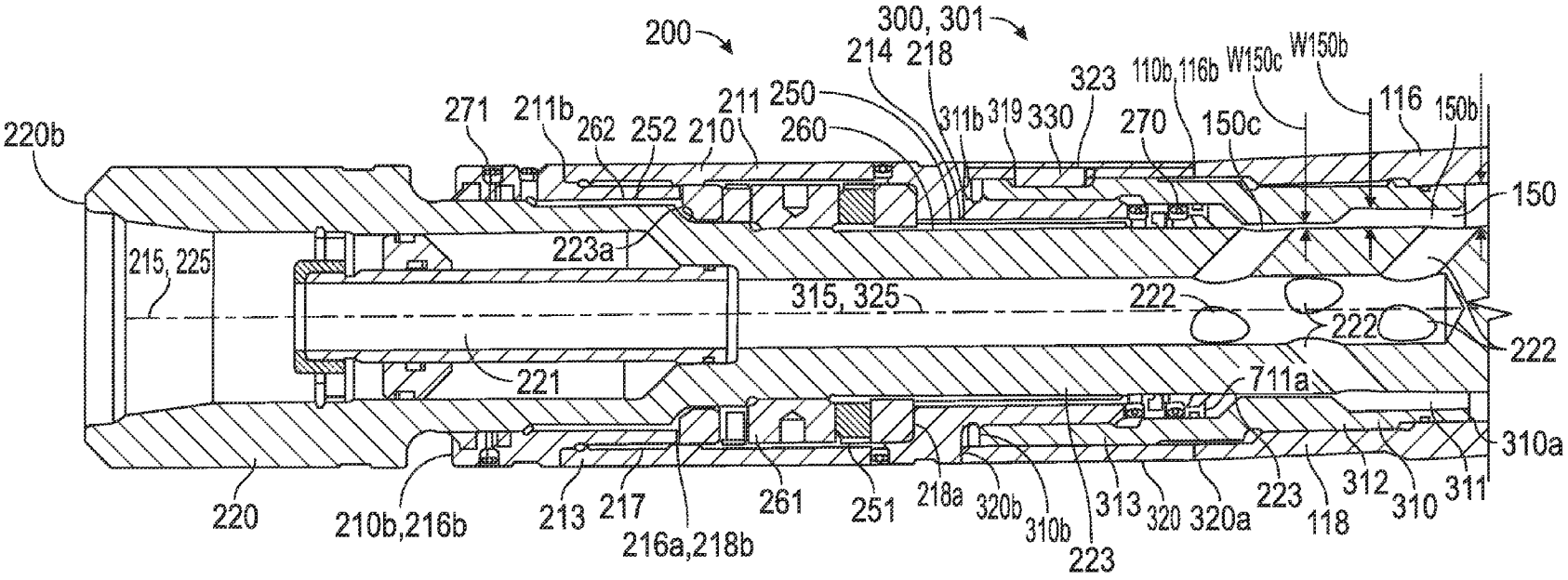
FIG. 6 is an enlarged cross-sectional view of the bearing assembly and bend adjustment assembly of FIG. 4.

Referring now to FIGS. 4 and 6, bearing assembly 200 includes bearing housing 210 and one-piece (i.e., unitary) bearing mandrel 220 rotatably disposed within housing 210. Bearing housing 210 has a linear central or longitudinal axis 215, a first or upper end 210*a* coupled to lower end 110*b* of driveshaft housing 110 with bend adjustment assembly 300, a second or lower end 210*b*, and a central through bore or passage 214 extending axially between ends 210*a*, 210*b*. Bearing housing 210 is coaxially aligned with bit 90, however, due to bend 301 between driveshaft assembly 100 and bearing assembly 200, bearing housing 210 is oriented at deflection angle θ relative to driveshaft housing 110.

In this embodiment, bearing housing 210 is formed from a pair of generally tubular housings connected together end-to-end. Namely, housing 210 includes a first or upper housing section 211 extending axially from upper end 210*a* and a second or lower housing section 216 extending axially from lower end 210*b* to housing section 211. Upper housing section 211 has a first or upper end 211*a* coincident with end 210*a* and a second or lower end 211*b* coupled to lower housing section 216. Upper end 210*a*, 211*a* comprises a threaded connector 212 and lower end comprises a threaded connector 213. Threaded connectors 212, 213 are coaxially aligned, each being concentrically disposed about axis 215. In this embodiment, connector 212 is an externally threaded connector or pin end and connector 213 is an internally threaded connector or box end.

Referring still to FIGS. 4 and 6, lower housing section 216 has a first or upper end 216*a* coupled to upper housing section 211 and a second or lower end 216*b* coincident with end 210*b*. Upper end 216*a* comprises a threaded connector 217 coaxially aligned with axis 215. In this embodiment, connector 217 is an externally threaded connector or pin end. Internally threaded connector 213 of upper housing section 211 threadably engages mating externally threaded connector 217 of lower housing section 211. As will be described in more detail below, upper end 210*b*, 211*a* of upper housing section 211, and in particular externally threaded connector 212, threadably engages a mating internally threaded component of bend adjustment assembly 300.

Referring still to FIGS. 4 and 6, bearing mandrel 220 has a central axis 225 coaxially aligned with central axis 215 of housing 210, a first or upper end 220*a*, a second or lower end 220*b*, and a central through passage 221 extending axially from lower end 220*b* and terminating axially below upper end 220*a*. Upper end 220*a* of mandrel 220 extends axially from upper end 210*a* of bearing housing 210 into passage 114 of driveshaft housing 110. In addition, upper end 220*a* is directly coupled to lower end 120*b* of driveshaft via one universal joint 140. In particular, upper end 220*a* is disposed within receptacle 121 at lower end 120*b* of driveshaft 120 and pivotally coupled thereto with one universal joint 140. Lower end 220*b* of mandrel 220 is coupled to drill bit 90.

Mandrel 220 also includes a plurality of circumferentially-spaced, and axially spaced drilling fluid ports 222 extending radially from passage 221 to the outer surface of mandrel 220. Ports 222 provide fluid communication between annulus 150 and passage 221. During drilling operations, mandrel 220 is rotated about axis 215 relative to housing 210. In particular, high pressure drilling mud is pumped through power section 40 to drive the rotation of rotor 50, which in turn drives the rotation of driveshaft 120, mandrel 220, and drill bit 90. The drilling mud flowing through power section 40 flows through annulus 150, ports 222 and passage 221 of mandrel 220 in route to drill bit 90.

As abrasive drilling fluid flows from annulus 150 into ports 222, an uneven distribution of drilling fluid among ports 222 can lead to excessive erosion—in general, ports (e.g., ports 222) that flow a greater volume of drilling fluid experience greater erosion than ports that flow a lesser volume of drilling fluid. However, in this embodiment, annulus 150 and ports 222 are sized, shaped, and oriented to facilitate a more uniform distribution of drilling fluid among the different ports 222, thereby offering the potential to reduce excessive erosion of certain ports 222. More specifically, each port 222 is oriented at an angle of 45° relative to axis 225 of mandrel 220. Further, the radial width of annulus 150 decreases moving axially towards ports 222. Namely, the portion of annulus 150 disposed about bearing mandrel 220 has three axially adjacent segments or sections that decrease in radial width moving axially towards ports 222. Moving towards ports 222, annulus 150 includes a first axial segment 150*a* having a radial width $W_{150a}$ measured radially from bearing mandrel 220 to housing 110, a second axial segment 150*b* adjacent segment 150*a* having a radial width $W_{150b}$ measured radially from bearing mandrel 220 to an adjustment mandrel 310 disposed within housing 110, and a third axial segment 150*c* adjacent segment 150*b* having a radial width $W_{150c}$ measured radially from bearing mandrel 220 to adjustment mandrel 310. Radial widths $W_{150a}$, $W_{150b}$ and $W_{150c}$ progressively decrease moving axially towards ports 222. Computational fluid dynamic (CFD) modeling indicates the angular orientation of ports 222 and stepwise decrease in radial width of annulus 150 moving axially towards ports 222 more uniformly distributes drilling fluid among the different ports 222.

Referring again to FIG. 4, as previously described, in this embodiment, driveshaft 120 is a unitary, single-piece and bearing mandrel 220 is unitary, single-piece. In particular, end 120*a* of driveshaft 120 is coupled to rotor 50 with a driveshaft adapter 130 and universal joint 140, and end 120*b* of driveshaft 120 is coupled to bearing mandrel 220 with receptacle 121 and universal joint 140. However, between ends 120*a*, 120*b* coupled to rotor 50 and bearing mandrel 220, driveshaft adapter 120 is a single, unitary, monolithic structure devoid of joints (e.g., universal joints). Similarly, end 220*a* of bearing mandrel 220 is coupled to driveshaft 120 via receptacle 121 and universal joint 140, and end 220*b* of bearing mandrel 220 is coupled to a drill bit. However, between ends 220*a*, 220*b* coupled to driveshaft 120 and the drill bit, bearing mandrel 220 is a single, unitary, monolithic structure devoid of joints (e.g., universal joints). Consequently, between rotor 50 and the drill bit, only two universal joints 140 are provided along the drivetrain comprising driveshaft 120 and bearing mandrel 220. Further, only one universal joint is provided between driveshaft 120 and bearing mandrel 220. Providing only a single universal joint 140 between driveshaft 120 and mandrel 220 eliminates any intermediary universal joints, which may increase the strength of the coupling between driveshaft 120 and mandrel 220, as well as facilitate a further reduction in the bit-to-bend distance D. In other embodiments, the driveshaft (e.g., driveshaft 120) and/or the bearing mandrel (e.g., bearing mandrel 220) may contain a varying number of universal joints (e.g., universal joints 140).

Referring still to FIGS. 4 and 6, housing 210 has a radially inner surface 218 that defines through passage 214. Inner surface 218 includes a plurality of axially spaced apart annular shoulders. Specifically, inner surface 218 includes a first annular shoulder 218*a* and a second annular shoulder 218*b* positioned axially below first shoulder 218*a*. Shoulders 218*a*, 218*b* face each other. First annular shoulder 218*a* is formed along inner surface 218 in upper housing section 211, and second annular shoulder 218*b* is defined by end 216*a* of lower housing section 216. Mandrel 220 has a radially outer surface 223 including an annular shoulder 223*a* axially aligned with shoulder 218*b*

As best shown in FIG. 6, a plurality of annuli are radially positioned between mandrel 220 and housing 210. In particular, a first or upper annulus 250 is axially positioned between housing shoulder 218*a* and end 210*a*, a second or intermediate annulus 251 is axially positioned between shoulder 218*a* and shoulders 223, 218*b*, and a third or lower annulus 252 is axially positioned between shoulders 223*a*, 218*b* and end 210*b*. An upper radial bearing 260 is disposed in upper annulus 250, a thrust bearing assembly 261 is disposed in intermediate annulus 251, and a lower radial bearing 262 is disposed in lower annulus 252.

Upper radial bearing 260 is disposed about mandrel 220 and axially positioned above thrust bearing assembly 261, and lower radial bearing 262 is disposed about mandrel 220 and axially positioned below thrust bearing assembly 261. In general, radial bearings 260, 262 permit rotation of mandrel 220 relative to housing 210 while simultaneously supporting radial forces therebetween. In this embodiment, upper radial bearing 260 and lower radial bearing 262 are both sleeve type bearings that slidingly engage cylindrical surfaces on the outer surface 223 of mandrel 220. However, in general, any suitable type of radial bearing(s) may be employed including, without limitation, needle-type roller bearings, radial ball bearings, or combinations thereof. Annular thrust bearing assembly 261 is disposed about mandrel 220 and permits rotation of mandrel 220 relative to housing 210 while simultaneously supporting axial loads in both directions (e.g., off-bottom and on-bottom axial loads). In this embodiment, thrust bearing assembly 261 generally comprises a pair of caged roller bearings and corresponding races, with the central race threadedly engaged to bearing mandrel 220. Although this embodiment includes a single thrust bearing assembly 261 disposed in one annulus 251, in other embodiments, more than one thrust bearing assembly (e.g., thrust bearing assembly 261) may be included, and further, the thrust bearing assemblies may be disposed in the same or different thrust bearing chambers (e.g., two-shoulder or four-shoulder thrust bearing chambers).

Figure 11:
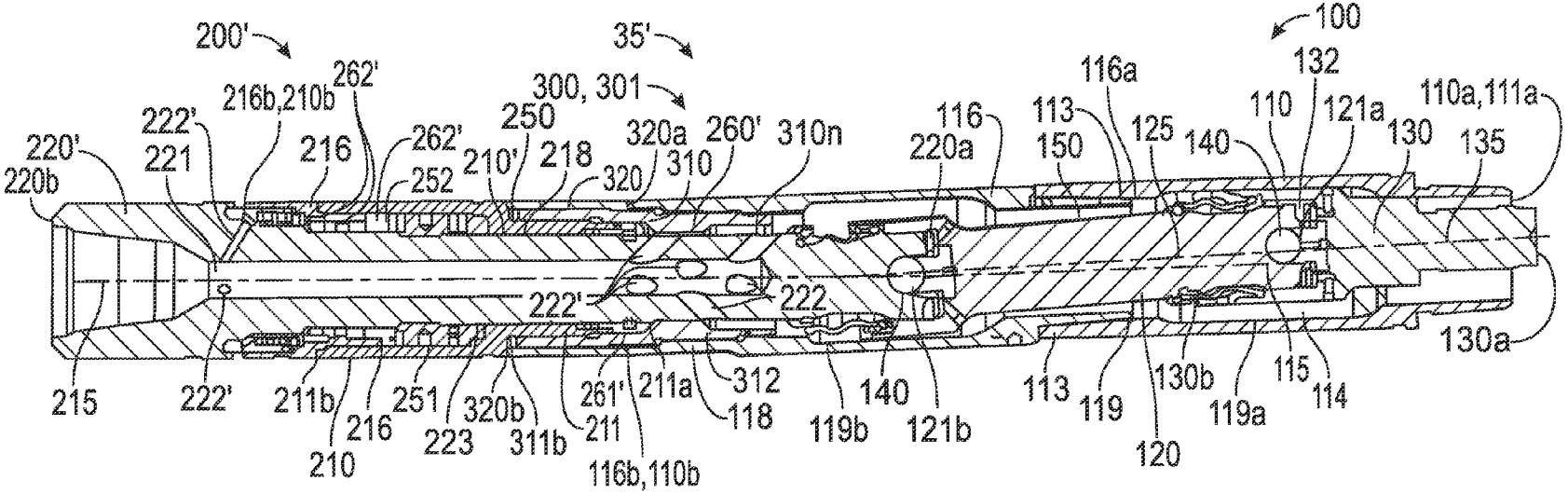
FIG. 11 is a cross-sectional view of another embodiment of a bearing mandrel in accordance with the principles disclosed herein.

In this embodiment, radial bearings 260, 262 and thrust bearing assembly 261 are oil-sealed bearings. In particular, an upper seal assembly 270 is radially positioned between upper end 210*a* of housing 210 and mandrel 220, and a lower seal assembly 271 is radially positioned between lower end 210*b* of housing 210 and mandrel 220. Seal assemblies 270, 271 provide annular seals between housing 210 and mandrel 220 at ends 210*a*, 210*b*, respectively. Thus, seal assemblies 270, 271 isolate radial bearings 260, 262 and bearing assembly 261 from drilling fluid in annulus 150 and drilling fluid in borehole 16, respectively. A pressure compensation system is preferably utilized in connection with oil-sealed bearings 260, 262, 261. Examples of pressure compensation systems that can be used in connection with bearings 260, 262, 261 are disclosed in U.S. Patent Application No. 61/765,164, which is herein incorporated by reference in its entirely. As previously described, in this embodiment, bearings 260, 261, 262 are oil-sealed. However, in other embodiments, the bearings of the bearing assembly (e.g., bearing assembly 200) are mud lubricated. For example, referring now to FIG. 11, an embodiment of a mud motor 35' is shown. Mud motor 35' is the same as mud motor 35 previously described with the exception that bearing assembly 200' includes mud-lubricated radial bearings 260', 262' and thrust bearing 261', seal assemblies 270, 271 are omitted to allow a portion of drilling mud flowing through annulus 150 to access bearings 260', 261', 262', and bearing mandrel 220' includes a plurality of circumferentially-spaced mud return ports 222' proximal lower end 220*b* for retuning drilling mud flowing through bearings 260', 261', 262' to central passage 221. Each port 222' extends radially from central passage 221 to the outer surface of mandrel 220'. Thus, in this embodiment, a portion of the drilling fluid flowing through annulus 150 bypasses ports 222 and lubricates bearings 260', 261' and 262' prior to returning to central passage 221 via ports 222'.

Referring now to FIGS. 1, 4, and 6, as previously described, bend adjustment assembly 300 couples driveshaft housing 110 to bearing housing 210, and introduces bend 301 and deflection angle θ along motor 35. Axis 115 of driveshaft housing 110 is coaxially aligned with axis 25 and axis 215 of bearing housing 210 is coaxially aligned with axis 95, thus, deflection angle θ also represents the angle between axes 115, 215 when mud motor 35 is in an undeflected state (e.g., outside borehole 16). Due to the deflection of motor 35 in borehole 16, the angle between axes 115, 215 will typically be less than deflection angle θ. As will be described in more detail below, deflection angle θ can be adjusted, as desired, with bend adjustment assembly 300.

As best shown in FIG. 6, in this embodiment, bearing adjustment assembly 300 includes an adjustment mandrel 310 and an adjustment lock ring 320. Adjustment mandrel 310 is disposed about mandrel 220 and ring 320 is disposed about adjustment mandrel 310. As will be described in more detail below, ring 320 enables the rotation of adjustment mandrel 310 relative to driveshaft housing 110 to adjust deflection angle θ between a maximum and a minimum.

Figure 7:
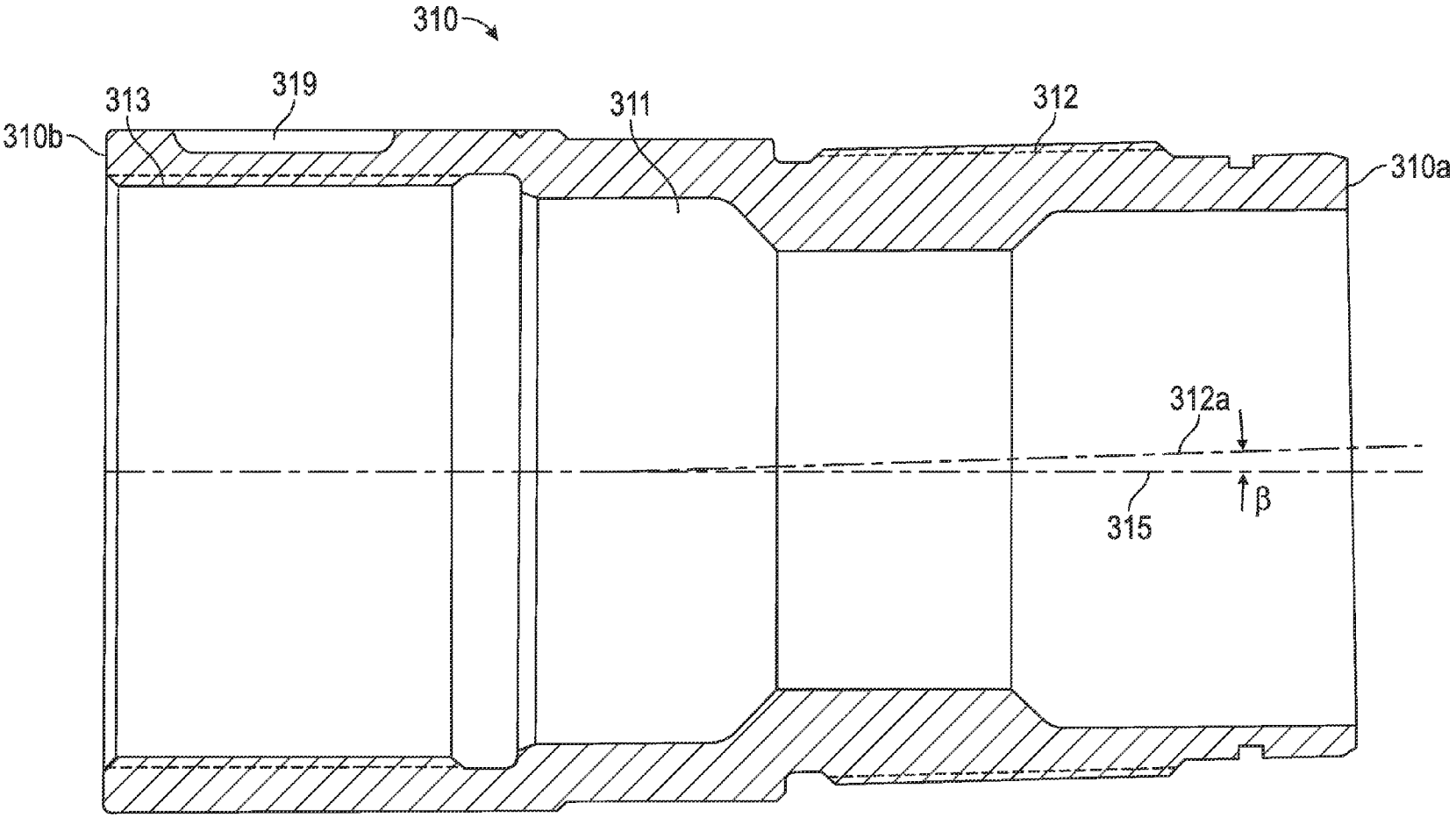
FIG. 7 is an enlarged cross-sectional view of the adjustment mandrel of FIG. 4.
Figure 8:
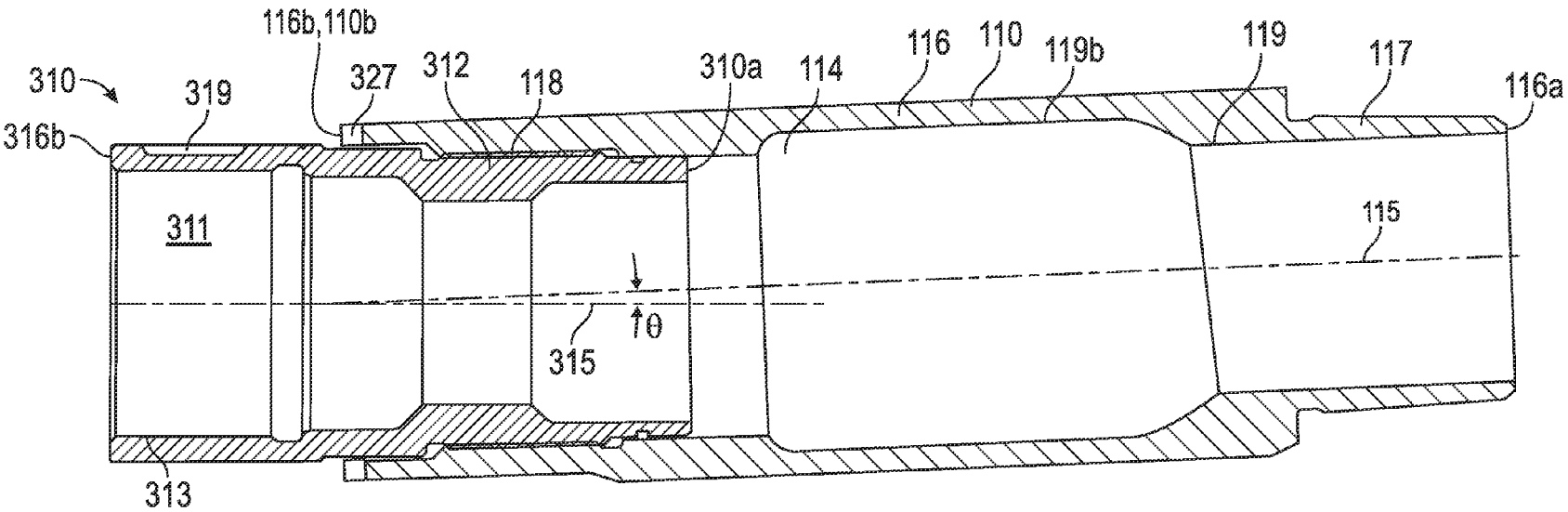
FIG. 8 is an enlarged cross-sectional view of the adjustment mandrel and the lower housing section of the driveshaft housing of FIG. 4.

Referring now to FIGS. 6-8, adjustment mandrel 310 has a central or longitudinal axis 315, a first or upper end 310*a*, a second or lower end 310*b* opposite end 310*a*, and a central through bore or passage 311 extending axially between ends 310*a*, 310*b*. Axis 315 is coaxially aligned with axis 215 of bearing housing 210.

Upper end 310*a* comprises a threaded connector 312 and lower end 310*b* comprises a threaded connector 313. Threaded connector 313 is coaxially aligned with axis 315, and concentrically disposed about axis 315, however, threaded connector 312 is concentrically disposed about an axis 312*a* oriented at a non-zero acute angle relative to axis 315. In this embodiment, connector 312 is an externally threaded connector or pin end, and connector 313 is an internally threaded connector or box end. Thus, axis 312*a* is the central axis of the threaded outer cylindrical surface of adjustment mandrel 310 at end 310*a*. Accordingly, connector 312 may be described as being "offset." Angle β is preferably greater than 0° and less than or equal to 2°, and preferably the same as angle α.

As best shown in FIGS. 6 and 8, externally threaded offset connector 312 of mandrel 310 threadably engages mating internally threaded offset connector 118 of lower housing section 116, and internally threaded connector 313 of mandrel 310 threadably engages mating externally threaded connector 212 of bearing housing 210. When connectors 118, 312 are threaded together and connectors 212, 313 are threaded together, axes 118*a*, 312*a* are coaxially aligned, axes 215, 315 are coaxially aligned, and axes 215, 315 are oriented at deflection angle θ relative to axis 115, thereby inducing bend 301 along motor 35. Depending on the rotational position of mandrel 310 relative to lower housing section 116, deflection angle θ can be adjusted to an intermediate angle between a minimum deflection angle $\theta_{min}$ equal to the difference of angles α, β (i.e., 0° if α=β) and a maximum deflection angle $\theta_{max}$ equal to the sum of angles α, β.

Referring now to FIGS. 6 and 7, the outer cylindrical surface of mandrel 310 includes a plurality of circumferentially-spaced elongate semi-cylindrical recesses 319 positioned proximal lower end 310*b*. Recesses 319 are oriented parallel to axis 315. As will be described in more detail below, each recess 319 receives a mating, elongate cylindrical spline 330. Although splines 330 slidingly engage recesses 319 in this embodiment, in other embodiments, a plurality of circumferentially-spaced splines can extend radially from and be integrally formed with the adjustment mandrel (e.g., mandrel 310).

Figure 9:
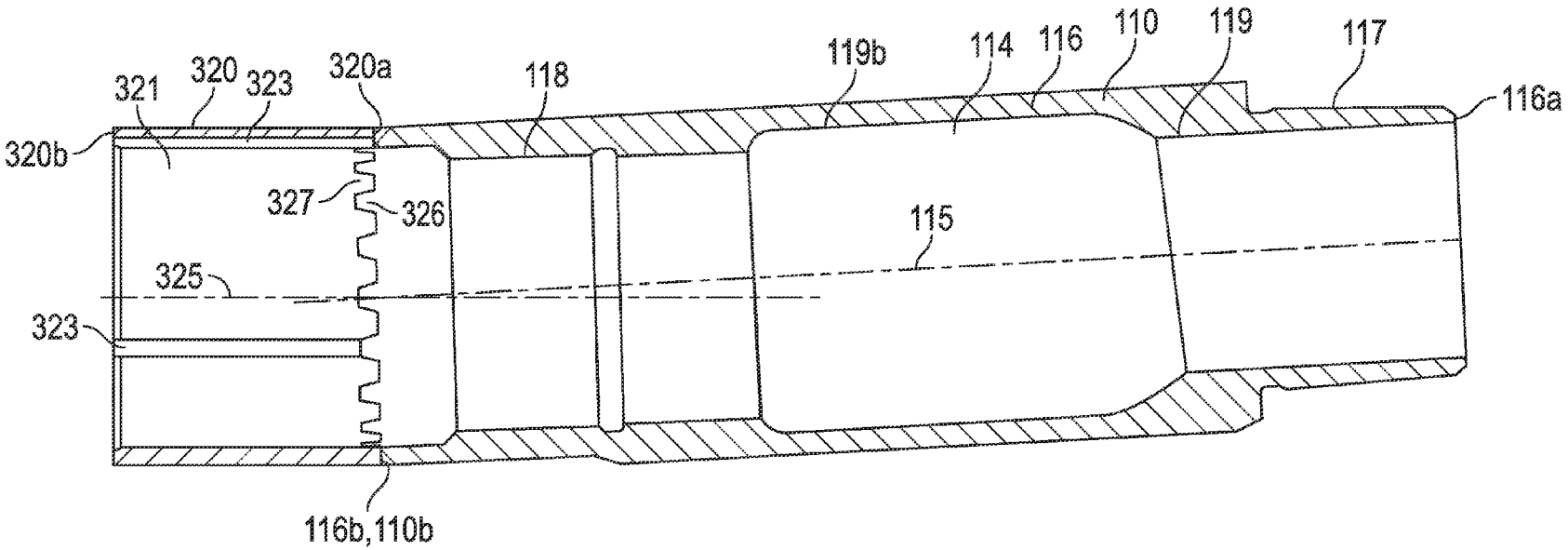
FIG. 9 is an enlarged cross-sectional view of the lower housing of the driveshaft assembly and the adjustment ring of FIG. 4 rotationally locked together.
Figure 10:
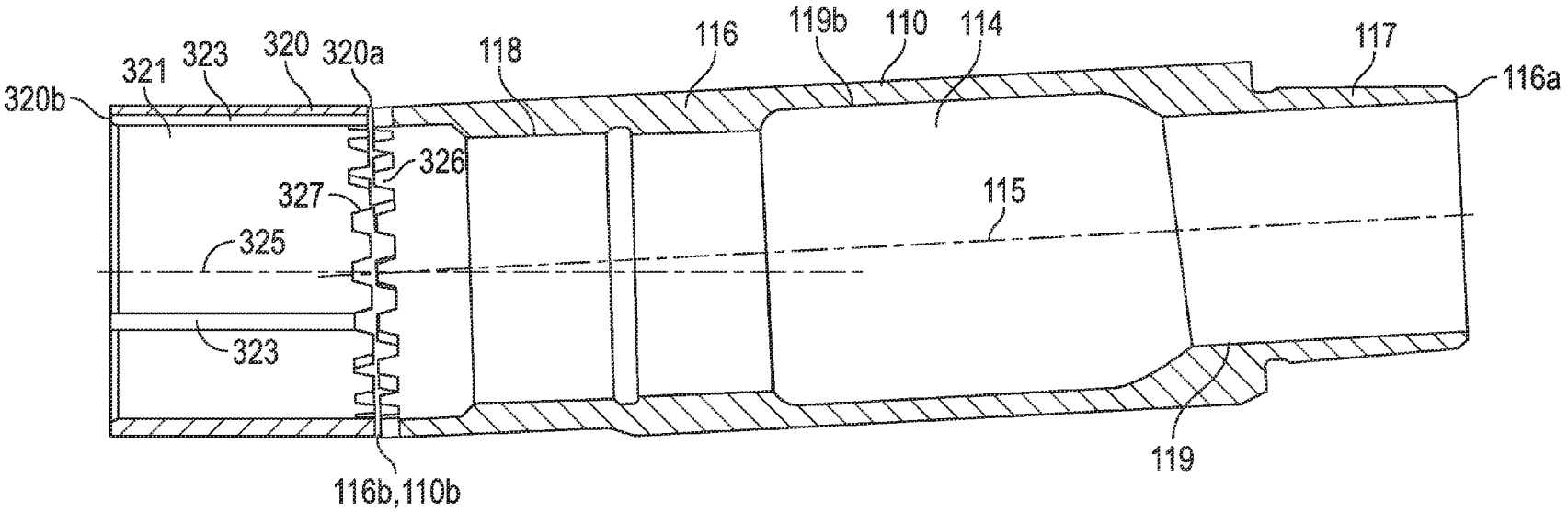
FIG. 10 is an enlarged cross-sectional view of the lower housing of the driveshaft assembly and the adjustment ring of FIG. 4 rotationally unlocked.

Referring now to FIGS. 6, 9, and 10, annular adjustment lock ring 320 is axially positioned between lower end 116*b* of lower housing section 116 and an annular shoulder 211*c* on the outer surface of upper housing section 211, and is disposed about upper end 211*a* of upper housing section 211 and lower end 310*b* of adjustment mandrel 310. Lock ring 320 has a central or longitudinal axis 325, a first or upper end 320*a*, a second or lower end 320*b* opposite end 320*a*, and a through bore or passage 321 extending axially between ends 320*a*, 320*b*. Passage 321 defines a cylindrical inner surface 322 extending between ends 320*a*, 320*b*. Inner surface 322 includes a plurality of circumferentially-spaced semi-cylindrical recesses 323, each recess 323 is oriented parallel to axis 325 and extends from upper end 320*a* to lower end 320*b*. As best shown in FIG. 7, when lock ring 320 is mounted to mandrel 310, each recess 323 is circumferentially aligned with a corresponding recess 319, and one spline 330 is disposed within each set of aligned recesses 319, 323. Splines 330 allow lock ring 320 to move axially relative to mandrel 310, but prevent lock ring 320 from moving rotationally relative to mandrel 310. Thus, by rotating lock ring 320 about axis 315, mandrel 310 is rotated about axis 315.

Referring now to FIGS. 9 and 10, adjustment ring 320 further includes a plurality of circumferentially spaced teeth 326 at upper end 320*a*. Teeth 326 are sized and shaped to releasably engage a mating set of circumferentially spaced teeth 327 at lower end 116*b* of lower housing section 116. As shown in FIG. 9, engagement and interlock of mating teeth 326, 327 prevents lock ring 320 from rotating relative to lower housing section 116, however, as shown in FIG. 10, when lock ring 320 is axially spaced from lower housing section 116 and teeth 326, 327 are disengaged, lock ring 320 can be rotated relative to lower housing section 116. It should also be appreciated that teeth 326, 327 can releasably engage and interlock while accommodating bend 301 at the junction of lock ring 320 and housing 110.

Referring now to FIGS. 1 and 4, prior to lowering BHA 30 downhole, the deflection angle θ is adjusted and set based on the projected or targeted profile of borehole 16 to be drilled with system 10. In general, the deflection angle θ can be adjusted and set at any angle between 0° and the sum of angles α, β by rotating annular adjustment ring 320 relative to housing 110. Deflection angle θ is controlled and varied via bend adjustment assembly 300. In particular, mandrel 310 is rotated relative to housing 110 via lock ring 320 and splines 330 to adjust and set deflection angle θ. As previously described, engagement of teeth 326, 327 prevents lock ring 320 from being rotated relative to housing 110, and thus, to enable rotation of lock ring 320 (and hence rotation of mandrel 310) relative to housing 110, teeth 326, 327 are disengaged. Thus, bearing housing 210 is unthreaded from mandrel 310 to create an axial clearance between lock ring 320 and shoulder 211*c*. With a sufficient axial clearance between lock ring 320 and shoulder 211*c*, lock ring 320 is slid axially downward away from housing 110 via sliding engagement of splines 330 and recesses 323 until teeth 326, 327 are fully disengaged. With teeth 326, 327 fully disengaged, torque is applied to adjustment ring 320 to rotate ring 320 and mandrel 310 (via splines 330) relative to housing 110. Rotation of mandrel 310 relative to housing 110 causes offset connector 312 of mandrel 310 to rotate relative to offset connector 118 of housing 110.

The full range in variation of deflection angle θ can be achieved by rotating mandrel 310 between 0° and 180° relative to housing 110, with the 0° angular position of mandrel 310 relative to housing 110 providing the minimum deflection angle $\theta_{min}$ equal to the difference between angles α, β (i.e., 0° if α=β), and the 180° angular position of mandrel 310 relative to housing 110 providing the maximum deflection angle $\theta_{max}$ equal to the sum of angles α, β. In general, deflection angle θ varies non-linearly moving between the 0° and 180° angular positions of mandrel 310 relative to housing 110. Thus, an incremental deflection angle θ between minimum deflection angle $\theta_{min}$ and maximum deflection angle $\theta_{max}$ can be set. The specific incremental values of deflection angle θ that can be selected depend on the quantity and spacing of teeth 326, 327 and the values of angles α, β. In this embodiment, the radially outer surfaces of lock ring 320 and housing 110 at ends 320*a*, 110*b*, respectively, are marked/indexed to provide an indication of the deflection angle θ for various angular positions of lock ring 320, and hence mandrel 310, relative to housing 110 between 0° and 180°.

Once mandrel 310 has been rotated sufficiently to provide the desired deflection angle θ, ring 320 is axially moved towards housing 110 to engage teeth 326, 327, which prevent relative rotation of lock ring 320 and mandrel 310 relative to housing 110, thereby locking in the desired deflection angle θ. Next, the bearing housing 210 is threaded into mandrel 310 until shoulder 211*c* axially abuts lock ring 320, thereby preventing lock ring 320 from moving axially away from housing 110 and disengaging teeth 326, 327.

In the manner described herein, an adjustable bend motor assembly is provided for use in drilling boreholes having non-vertical or deviated sections. As compared to most conventional bent motor assemblies, embodiments described herein provide a substantially reduced bit-to-bend distance via a bend positioned immediately above the bearing housing and axial overlap of the bend adjustment assembly with the bearing assembly mandrel. The reduced bit-to-bend distance offers the potential to enhance durability and build rates. In particular, for a given deflection angle, the magnitude of the bending moments and stresses experienced by downhole mud motors are directly related to the bit-to-bend distance (i.e., the greater the bit-to-bend distance, the greater the bending moments). Consequently, the maximum deflection angle of a downhole mud motor is typically limited by the magnitude of the stresses resulting from the bending moments. Therefore, by decreasing the bit-to-bend distance for a given deflection angle, embodiments described herein offer the potential to reduce bending moments and associated stresses experienced by the downhole mud motor. In addition, a shorter bit-to-bend distance decreases the minimum radius of curvature (i.e., a sharper bend) of the borehole path that can be excavated by the drill bit at a given deflection angle provided by the bent housing. For a borehole having a deviated section that includes a desired radius of curvature, by decreasing the bit-to-bend distance, a smaller deflection angle of the bent housing can be used in order to produce a borehole section at that desired radius. Thus, a downhole motor having a relatively short bit-to-bend distance may both reduce stresses imparted to the motor at a given deflection angle and allow for the use of a smaller deflection angle to drill a borehole having a desired radius of curvature.

Moreover, in conventional mud motors, the threaded connection between the upper end of the bearing mandrel and an adapter threaded thereon and coupled to the lower end of the driveshaft with a universal joint is particularly susceptible to failure or fracturing when excessive bending moments and stresses are applied to the motor. However, in embodiments described herein, that threaded connection is eliminated. In particular, as previously described, upper end 220*a* of bearing mandrel 220 is disposed in receptacle 121 provided at lower end 120*b* of driveshaft 120 and coupled to driveshaft 120 with universal joint 140. In other words, no adapter is threaded onto upper end 220*a* of bearing mandrel 220 in this embodiment.

Although embodiments of mud motor 35 described herein include an adjustable bend 301, potential advantageous features of mud motor 35 can also be used in connection with fixed bend mud motors. For example, a mud flow annulus having a decreasing radial width moving towards the mud inlet ports of the mandrel can be employed in fixed bend mud motors to more uniformly distribute drilling fluid amongst the inlet ports. As another example, a bearing mandrel having an upper end coupled to the lower end of a driveshaft without a threaded connection can be employed in fixed bend mud motors to enhance durability.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A downhole motor for directional drilling, comprising:

a driveshaft assembly including a driveshaft housing and a driveshaft rotatably disposed within the driveshaft housing;

wherein the driveshaft housing has a central axis, a first end, and a second end opposite the first end;

wherein the driveshaft has a central axis, a first end, a second end opposite the first end, and a receptacle extending axially from the second end of the driveshaft;

a bearing assembly including a bearing housing and a bearing mandrel rotatably disposed within the bearing housing;

wherein the bearing housing has a central axis, a first end comprising a connector, and a second end opposite the first end;

wherein the bearing mandrel has a central axis coaxially aligned with the central axis of the bearing housing, a first end directly connected to the second end of the driveshaft with a universal joint, and a second end coupled to a drill bit, wherein the first end of the bearing mandrel is disposed within the receptacle of the driveshaft;

an adjustment mandrel configured to adjust an acute deflection angle θ between the central axis of the bearing housing and the central axis of the driveshaft housing;

wherein the adjustment mandrel has a central axis coaxially aligned with the central axis of the bearing housing, a first end, and a second end opposite the first end;

wherein the first end of the adjustment mandrel is coupled to the second end of the driveshaft housing and the second end of the adjustment mandrel is coupled to the first end of the bearing housing.

2. The downhole motor of claim 1, wherein the connector of the first end of the bearing housing comprises a threaded connector and wherein the first end of the adjustment mandrel is threadably coupled to the second end of the driveshaft housing and the second end of the adjustment mandrel is threadably coupled to the first end of the bearing housing.

3. The downhole motor of claim 2, wherein the second end of the driveshaft housing comprises a threaded connector concentrically disposed about a first offset axis oriented at an acute angle α relative to the central axis of the driveshaft housing;

wherein the first end of the adjustment mandrel comprises a threaded connector concentrically disposed about a second offset axis oriented at an acute angle β relative to the central axis of the adjustment mandrel.

4. The downhole motor of claim 3, wherein the second end of the driveshaft includes a receptacle, and wherein the first end of the mandrel and the universal joint are disposed in the receptacle.

5. The downhole motor of claim 3, wherein at least one radial bearing and a thrust bearing are radially positioned between the first end of the bearing housing and the bearing mandrel, wherein the at least one radial bearing is configured to support radial loads and the thrust bearing is configured to support axial loads.

6. The downhole motor of claim 3, wherein the second end of driveshaft housing comprises an internally threaded connector, the first end of adjustment mandrel comprises an externally threaded connector, the second end of adjustment mandrel comprises an internally threaded connector, and the first end of bearing housing comprises an externally threaded connector.

7. The downhole motor of claim 2, further comprising a lock ring disposed about the adjustment mandrel and the first end of the bearing housing, wherein the lock ring is configured to rotationally lock the adjustment mandrel to the driveshaft housing.

8. The downhole motor of claim 7, wherein the lock ring is configured to move axially relative to the adjustment mandrel and is prevented from moving rotationally relative to the adjustment mandrel.

9. The downhole motor of claim 8, wherein the lock ring has an inner surface comprising a plurality of circumferentially-spaced recesses;

wherein the adjustment mandrel has an outer surface comprising a plurality of circumferentially-spaced recesses, wherein one recess of the adjustment mandrel is circumferentially aligned with one recess of the lock ring; and wherein a spline is disposed in each set of aligned recesses.

10. The downhole motor of claim 8, wherein the lock ring has a first end comprising a plurality of circumferentially-spaced teeth that releasably engage and interlock with a plurality of mating circumferentially-spaced teeth on the second end of the driveshaft housing.

11. The downhole motor of claim 2, wherein the bearing mandrel extends axially into the driveshaft housing.

12. The downhole motor of claim 2, wherein the bearing mandrel extends completely through the adjustment mandrel.

13. The downhole motor of claim 2, wherein the bearing mandrel is a unitary single-piece and the driveshaft mandrel is a unitary single-piece.

14. The downhole motor of claim 2, wherein only one universal joint is provided between the bearing mandrel and the driveshaft.

15. The downhole motor of claim 2 wherein the central axis of the driveshaft is linear and the bearing mandrel has a linear central axis.

16. The downhole motor of claim 2, wherein the bearing mandrel comprises a plurality of axially spaced ports and wherein each port is disposed at an acute angle relative to a central axis of the bearing mandrel.

17. The downhole motor of claim 16, further comprising an annulus formed about an outer surface of the bearing mandrel having a decreasing radial width moving axially towards the plurality of ports.

18. The downhole motor of claim 1, wherein an angular offset between the central axis of the adjustment mandrel and the central axis of the driveshaft housing is concentrically disposed about the bearing mandrel.

19. The downhole motor of claim 1, wherein the first end of the adjustment mandrel comprises a threaded connector having a central axis, and wherein the second end of the driveshaft housing comprises a threaded connector having a central axis coaxially aligned with the central axis of the threaded connector of the adjustment mandrel and oriented at an acute angle relative to the central axis of the driveshaft housing.

20. The downhole motor of claim 17, wherein the annulus has a first portion with a first radial width, a second portion with a second radial width, and a third portion with a third radial width, wherein the first portion extends axially from the first end of the bearing mandrel to the second portion, wherein the third portion extends axially from the second radial portion to the plurality of ports, wherein the first radial width is larger than the second radial width and the third radial width, and wherein the third radial width is smaller than the second radial width.

21. A downhole motor for directional drilling, comprising:

a driveshaft assembly including a driveshaft housing and a driveshaft rotatably disposed within the driveshaft housing;

wherein the driveshaft housing has a central axis, a first end, and a second end opposite the first end;

wherein the driveshaft has a central axis, a first end, a second end opposite the first end, and a receptacle extending axially from the second end of the driveshaft;

a bearing assembly including a bearing housing and a bearing mandrel coaxially disposed within the bearing housing;

wherein the bearing housing has a central axis, a first end, and a second end opposite the first end;

wherein the bearing mandrel has a first end pivotally coupled to the second end of the driveshaft and a second end coupled to a drill bit, wherein the first end of the bearing mandrel is disposed within the receptacle of the driveshaft, wherein the first end of the bearing mandrel extends from the bearing housing into the driveshaft housing;

an adjustment mandrel having a first end coupled to the second end of the driveshaft housing and a second end coupled to the first end of the bearing housing, wherein rotation of the adjustment mandrel relative to the driveshaft housing is configured to adjust an acute deflection angle θ between the central axis of the driveshaft housing and the central axis of the bearing housing.

22. The downhole motor of claim 21, wherein the first end of the adjustment mandrel is threadably coupled to the second end of the driveshaft housing and the second end of the adjustment mandrel is threadably coupled to the first end of the bearing housing.

23. The downhole motor of claim 22, wherein the second end of the driveshaft housing comprises a threaded connector concentrically disposed about a first offset axis oriented at an acute angle α relative to the central axis of the driveshaft housing;

wherein the first end of the adjustment mandrel comprises a threaded connector concentrically disposed about a second offset axis oriented at an acute angle β relative to the central axis of the adjustment mandrel.

24. The downhole motor of claim 23, wherein the second end of the driveshaft includes a receptacle, and wherein the first end of the mandrel and the universal joint are disposed in the receptacle.

25. The downhole motor of claim 23, wherein at least one radial bearing and a thrust bearing are radially positioned between the first end of the bearing housing and the bearing mandrel, wherein the at least one radial bearing is configured to support radial loads and the thrust bearing is configured to support axial loads.

26. The downhole motor of claim 23, wherein the second end of driveshaft housing comprises an internally threaded connector, the first end of adjustment mandrel comprises an externally threaded connector, the second end of adjustment mandrel comprises an internally threaded connector, and the first end of bearing housing comprises an externally threaded connector.

27. The downhole motor of claim 22, further comprising a lock ring disposed about the adjustment mandrel and the first end of the bearing housing, wherein the lock ring is configured to rotationally lock the adjustment mandrel to the driveshaft housing.

28. The downhole motor of claim 22, wherein the bearing mandrel extends completely through the adjustment mandrel.

29. The downhole motor of claim 22, wherein the bearing mandrel is a unitary single-piece and the driveshaft mandrel is a unitary single-piece driveshaft.

30. The downhole motor of claim 22, wherein only one universal joint is provided between the bearing mandrel and the driveshaft.

31. The downhole motor of claim 22 wherein the central axis of the driveshaft is linear and the bearing mandrel has a linear central axis.

32. The downhole motor of claim 22, wherein the bearing mandrel comprises a plurality of axially spaced ports and wherein each port is disposed at an acute angle relative to a central axis of the bearing mandrel.

33. The downhole motor of claim 32, further comprising an annulus formed about an outer surface of the bearing mandrel having a decreasing radial width moving axially towards the plurality of ports.

34. A downhole motor for directional drilling, comprising:

a driveshaft assembly including a driveshaft housing and a driveshaft rotatably disposed within the driveshaft housing;

wherein the driveshaft housing has a central axis, a first end, and a second end opposite the first end;

wherein the driveshaft has a central axis, a first end, a second end opposite the first end, and a receptacle extending axially from the second end of the driveshaft;

a bearing assembly including a bearing housing and a bearing mandrel rotatably disposed within the bearing housing;

wherein the bearing housing has a central axis, a first end, and a second end opposite the first end;

wherein the bearing mandrel has a first end pivotally coupled to the driveshaft and a second end coupled to a drill bit, wherein the first end of the bearing mandrel is disposed within the receptacle of the driveshaft;

wherein the central axis of the driveshaft housing is oriented at an acute deflection angle θ relative to the central axis of the bearing housing.

35. The downhole motor of claim 34, further comprising an adjustment mandrel having a first end threadably coupled to the second end of the driveshaft housing and a second end threadably coupled to the first end of the bearing housing.

36. The downhole motor of claim 35, wherein the second end of the driveshaft housing comprises a threaded connector concentrically disposed about a first offset axis oriented at an acute angle α relative to the central axis of the driveshaft housing;

wherein the first end of the adjustment mandrel comprises a threaded connector concentrically disposed about a second offset axis oriented at an acute angle β relative to the central axis of the adjustment mandrel.

37. The downhole motor of claim 35, wherein at least one radial bearing and a thrust bearing are radially positioned between the first end of the bearing housing and the bearing mandrel wherein the at least one radial bearing is configured to support radial loads and the thrust bearing is configured to support axial loads.

38. The downhole motor of claim 35, further comprising a lock ring disposed about the adjustment mandrel and the first end of the bearing housing, wherein the lock ring is configured to rotationally lock the adjustment mandrel to the driveshaft housing.

39. The downhole motor of claim 35, wherein the bearing mandrel extends completely through the adjustment mandrel into the driveshaft housing.

40. The downhole motor of claim 35, wherein the bearing mandrel is a unitary single-piece and the driveshaft mandrel is a unitary single-piece driveshaft.

41. The downhole motor of claim 35, wherein only one universal joint is provided between the bearing mandrel and the driveshaft.

42. The downhole motor of claim 35, wherein the central axis of the driveshaft is linear and the bearing mandrel has a linear central axis.

43. The downhole motor of claim 35, wherein the bearing mandrel comprises a plurality of axially spaced ports and wherein each port is disposed at an acute angle relative to the central axis of the bearing mandrel.

44. The downhole motor of claim 43, further comprising an annulus formed about an outer surface of the bearing mandrel having a decreasing radial width moving axially towards the plurality of ports.

45. The downhole motor of claim 21, wherein the first end of the adjustment mandrel comprises a threaded connector having a central axis, and wherein the second end of the driveshaft housing comprises a threaded connector having a central axis coaxially aligned with the central axis of the threaded connector of the adjustment mandrel and oriented at an acute angle relative to the central axis of the driveshaft housing.

46. The downhole motor of claim 27, wherein threaded engagement between the first end of the bearing housing and the second end of the adjustment mandrel restricts axial movement of the lock ring.

47. The downhole motor of claim 35, wherein the bearing mandrel extends through a bend between the adjustment mandrel and the driveshaft housing.

48. The downhole motor of claim 43, wherein each port has a central axis oriented at 45° relative to the central axis of the bearing mandrel.

* * * * *